US012691323B2

(12) United States Patent
Mason

(10) Patent No.: US 12,691,323 B2
(45) Date of Patent: Jul. 28, 2026

(54) EXERCISE DEVICE

(71) Applicant: John Mason, Disputanta, VA (US)

(72) Inventor: John Mason, Disputanta, VA (US)

( * ) Notice: Subject to any disclaimer, the term of this patent is extended or adjusted under 35 U.S.C. 154(b) by 147 days.

(21) Appl. No.: 18/733,962

(22) Filed: Jun. 5, 2024

(65) Prior Publication Data

US 2024/0408438 A1 Dec. 12, 2024

Related U.S. Application Data

(60) Provisional application No. 63/506,377, filed on Jun. 6, 2023.

(51) Int. Cl.

| | |
|---|---|
| ***A63B 21/00*** | (2006.01) |
| ***A63B 21/002*** | (2006.01) |
| ***A63B 21/04*** | (2006.01) |
| ***A63B 21/055*** | (2006.01) |
| ***A63B 22/00*** | (2006.01) |
| ***A63B 22/20*** | (2006.01) |
| ***A63B 71/00*** | (2006.01) |

(52) U.S. Cl.

CPC .... *A63B 21/4035* (2015.10); *A63B 21/00185* (2013.01); *A63B 21/002* (2013.01); *A63B 21/0442* (2013.01); *A63B 21/0552* (2013.01); *A63B 22/0005* (2015.10); *A63B 22/001* (2013.01); *A63B 22/20* (2013.01); *A63B 71/0036* (2013.01); *A63B 2022/0033* (2013.01); *A63B 2208/0219* (2013.01); *A63B 2225/09* (2013.01)

(58) Field of Classification Search

CPC ..... A63B 21/00185; A63B 21/002; A63B 21/0442; A63B 21/0552; A63B 21/4035; A63B 22/0005; A63B 22/001; A63B 22/20; A63B 23/0211; A63B 71/0036; A63B 2022/0033; A63B 2208/0219; A63B 2225/09

See application file for complete search history.

(56) References Cited

U.S. PATENT DOCUMENTS 3,880,443 A * 4/1975 Tobin ..... A63C 11/222 473/203
4,351,526 A * 9/1982 Schwartz ..... A63B 21/4019 482/108
5,261,866 A * 11/1993 Mattox ..... A63B 22/20 482/125
5,364,338 A * 11/1994 Terashima ..... A61H 15/0092 601/118
5,823,922 A * 10/1998 Eckmann ..... A63B 21/4035 482/44

(Continued)

*Primary Examiner* — Joshua Lee
(74) *Attorney, Agent, or Firm* — Brennan, Manna & Diamond, LLC

(57) ABSTRACT

An exercise device is provided. The device is comprised of a body with a recessed area and an appendage that promotes ergonomic hand placement and grip. The body is comprised of two rotating end caps that allow the body to roll along a ground surface when performing ab/core exercises. In another embodiment, the device can be used as a grip for pushups, wherein the body is placed into a base that inhibits rotation/movement of the end caps. In either embodiment, the device may also be comprised of a retractable resistance band to provide additional resistance while exercising using the device.

18 Claims, 8 Drawing Sheets

(56) References Cited

U.S. PATENT DOCUMENTS

| | | | | | |
|---|---|---|---|---|---|
| 6,093,136 | A * | 7/2000 | Whipple | A63B 21/169 | 482/910 |
| 6,203,476 | B1 * | 3/2001 | Wang | A63B 21/0618 | 482/121 |
| 6,328,680 | B1 * | 12/2001 | Shifferaw | A63B 21/0618 | 482/907 |
| D453,542 | S * | 2/2002 | Louiso | D21/694 | |
| 6,629,913 | B2 * | 10/2003 | Chen | A63B 21/0004 | 482/121 |
| 6,709,370 | B1 * | 3/2004 | Evans | A63B 21/078 | 482/142 |
| 7,387,599 | B1 * | 6/2008 | Hsu | A63B 21/0552 | 601/118 |
| D688,337 | S | 8/2013 | Huang | | |
| D730,455 | S | 5/2015 | Burris | | |
| D770,579 | S * | 11/2016 | Chang | A63B 22/20 | D21/691 |
| 9,586,088 | B2 * | 3/2017 | Wong | B32B 27/00 | |
| D794,725 | S | 8/2017 | Lamothe | | |
| 9,895,285 | B2 * | 2/2018 | Ingrassia | A61H 39/04 | |
| 10,335,628 | B1 * | 7/2019 | Scarpa | A63B 21/00061 | |
| D877,822 | S | 3/2020 | Ross | | |
| 10,610,724 | B2 * | 4/2020 | Chuang | A63B 21/0442 | |
| D949,252 | S | 4/2022 | Chen | | |
| 12,127,991 | B2 * | 10/2024 | Daley | A61H 15/0092 | |
| 2008/0070762 | A1 * | 3/2008 | White | A63B 23/1281 | 482/108 |
| 2015/0328491 | A1 * | 11/2015 | Miller | A63B 21/4025 | 482/121 |

* cited by examiner

EXERCISE DEVICE

CROSS-REFERENCE TO RELATED APPLICATION

The present application claims priority to, and the benefit of, U.S. Provisional Application No. 63/506,377, which was filed on Jun. 6, 2023, and is incorporated herein by reference in its entirety.

FIELD OF THE INVENTION

The present invention relates generally to the field of exercise devices. More specifically, the present invention relates to an exercise device that can be used as an ab-rolling device as well as a pushup hand grip device. Accordingly, the present disclosure makes specific reference thereto. Nonetheless, it is to be appreciated that aspects of the present invention are also equally applicable to other like applications, devices, and methods of manufacture.

BACKGROUND

Existing ab roller devices and pushup hand grip devices do not provide ergonomic grip placement/grip angles. This oversight in design significantly impacts the user experience, as it can lead to suboptimal hand and wrist positioning while using said devices to exercise. Said improper alignment increases the risk of strains and injuries, particularly in the wrists and forearms. Moreover, the absence of ergonomically designed grip angles often results in an uneven distribution of pressure across the user's hands and wrists. This not only causes immediate discomfort during exercise but also raises the potential for longer-term health issues, such as repetitive strain injuries or chronic wrist pain. Additionally, existing devices do not provide a natural, anatomical alignment of the user's body. This misalignment can lead to an increased likelihood of pain and potential injury, not just in the wrists but also in the shoulders and back, as users may compensate for the discomfort with poor posture.

Therefore, there exists a long-felt need in the art for an improved exercise device. There also exists a long-felt need for an improved exercise device for performing ab/core exercises as well as pushups. More specifically, there exists a long-felt need in the art for an exercise device that provides ergonomic grip and hand placement for a user. In addition, there exists a long-felt need in the art for an exercise device that provides an ergonomic grip and hand placement for a user while the device is used to perform push-ups and/or ab/core exercises.

The subject matter disclosed and claimed herein, in one embodiment thereof, comprises an exercise device. The device is comprised of a body with a recessed area and an appendage that promotes ergonomic hand placement and grip. The body is comprised of two rotating end caps that allow the body to roll along a ground surface when performing ab/core exercises. In another embodiment, the device can be used as a grip for pushups, wherein the body is placed into a base that inhibits rotation/movement of the end caps. In either embodiment, the device may also be comprised of a retractable resistance band to provide additional resistance while exercising using the device.

In this manner, the exercise device of the present invention accomplishes all the foregoing objectives and provides an improved exercise device for performing ab/core exercises. The device also provides an improved exercise device for performing pushups. More specifically, the device provides an ergonomic grip and hand placement for a user while performing push-ups and/or ab/core exercises.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an exercise device comprised of a body comprised of at least one recessed area, at least one appendage, and at least two ends. The device can be used to perform various core and upper body exercises.

The body of the device is comprised of at least one recessed area that receives the thumb of a user, wherein the thumb is placed around an appendage that extends away from the body. The shape and spatial relationship between the body, recessed area, and appendage allows a user to grip the body ergonomically while reducing wrist strain. In different embodiments, the recessed area and appendage may be positioned on the body to accommodate a right-handed or left-handed grip on the body.

The body is also comprised of two ends, each comprised of at least one cap that is preferably circular to allow the body to roll while performing core exercises. In one embodiment the caps are ridged to prevent the caps from excessively slipping on a ground surface while being used to exercise. The caps preferably rotate 360 degrees relative to the Y-axis of the body to allow the body to move while keeping the user's grip angle on the body constant. This embodiment of the device can be used similarly to an ab-roller to perform various core workouts. In said workouts, a user grabs the body with at least one hand and rolls the device away from their body while kneeling.

In one embodiment, the body can be used as a hand grip for performing elevated pushups. In this embodiment, the body is received by at least one base. The base adequately supports and prevents rotation of the end caps and allows the body to remain stationary and used as a pushup grip while stable.

In one embodiment, the device may also be comprised of at least one resistance band. The band is comprised of a first end and a second end. Each end is comprised of at least one fastener that allows each end to attach around/to the body. In this manner, the band can be connected to the body and the band can also be attached around the bottom of a user's foot while performing a core exercise to provide additional resistance.

The present invention is also comprised of a method of using the device. First, a device is provided comprised of a body comprised of at least one recessed area, at least one appendage, and at least two caps that rotate 360 degrees relative to the Y-axis of the body. Then, the device can be placed on a ground surface and a user can kneel or plank on said ground surface. Optionally, a user can extend a resistance band from a housing, adjust the length (and thus resistance) of the band via at least one fastener of the band, attach both ends of the band to the body via at least one fastener of each end, and place the band around a bottom of a user's foot. Then, a user can extend their arms to roll the body away from their body while using their core to keep their body above the ground surface. Then, a user can retract their arms to roll the body towards their body while using their core to keep their body above the ground surface.

The present invention is also comprised of a second method of using the device. First, a device is provided comprised of a body comprised of at least one recessed area, at least one appendage, and at least two caps that rotate 360 degrees relative to the Y-axis of the body, and a base that receives and inhibits movement of the body. Then, the base can be placed on a ground surface and a user can place the caps of the body into a channel of each side wall of the base such that the caps also rest in a recessed area of a bottom wall of the base. Optionally, a user can extend a resistance band from a housing, adjust the length (and thus resistance) of the band via at least one fastener of the band, attach both ends of the band to the body via at least one fastener of each end, and place the band around their shoulder/back area. Then, a user can get into a pushup position while gripping the body with their hand. Finally, a user can perform a pushup while gripping the body.

Accordingly, the exercise device of the present invention is particularly advantageous as it provides an improved exercise device for performing ab/core exercises. The device also provides an improved exercise device for performing pushups. More specifically, the device provides an ergonomic grip and hand placement for a user while performing push-ups and/or ab/core exercises. In this manner, the exercise device overcomes the limitations of existing exercise devices for performing pushups and ab/core exercises known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
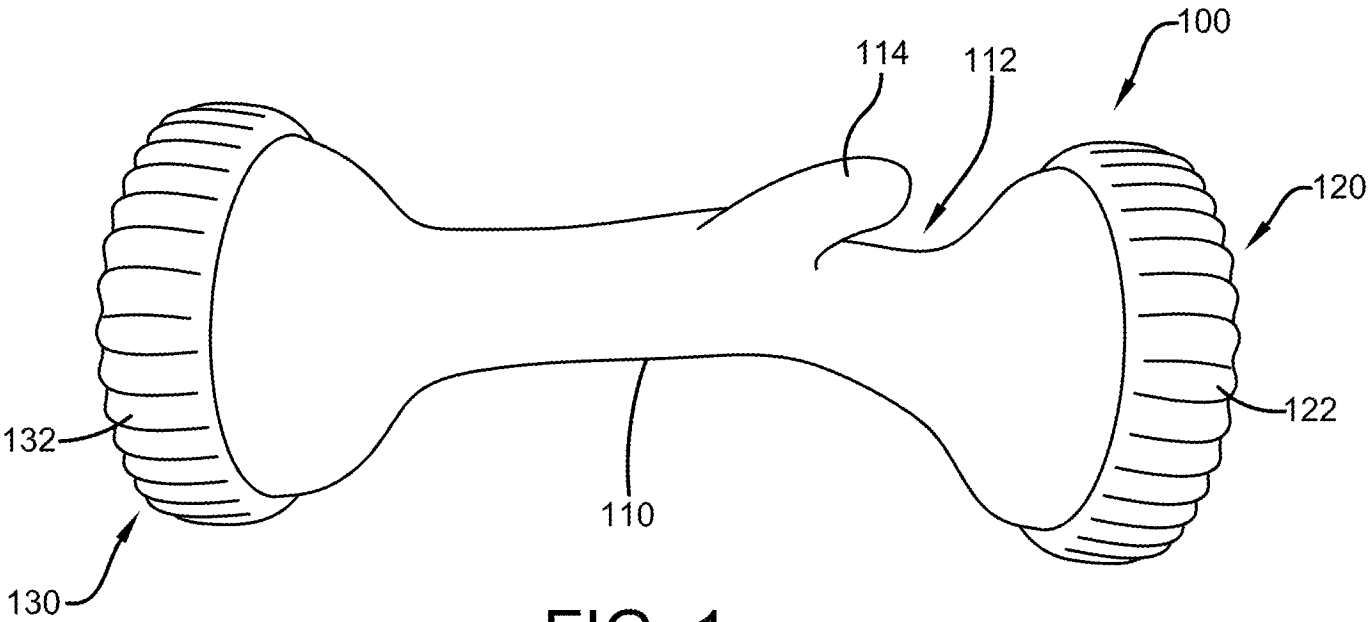
FIG. 1 illustrates a front perspective view of one potential embodiment of an exercise device of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for an improved exercise device. There also exists a long-felt need for an improved exercise device for performing ab/core exercises as well as pushups. More specifically, there exists a long-felt need in the art for an exercise device that provides ergonomic grip and hand placement for a user. In addition, there exists a long-felt need in the art for an exercise device that provides an ergonomic grip and hand placement for a user while the device is used to perform push-ups and/or ab/core exercises.

The present invention, in one exemplary embodiment, is comprised of an exercise device. The device is comprised of a body comprised of at least one recessed area, at least one appendage, and at least two ends. The device can be used to perform various core and upper body exercises. The body of the device is comprised of at least one recessed area that receives the thumb of a user, wherein the thumb is placed around an appendage that extends away from the body. The shape and spatial relationship between the body, recessed area, and appendage allows a user to grip the body ergonomically while reducing wrist strain. The recessed area and appendage may be positioned on the body to accommodate a right-handed or left-handed grip on the body.

The body is also comprised of two ends, each comprised of at least one cap that is preferably circular to allow the body to roll while performing core exercises. In one embodiment the caps are ridged to prevent the caps from excessively slipping on a ground surface while being used to exercise. The caps preferably rotate 360 degrees relative to the Y-axis of the body to allow the body to move while keeping the user's grip angle on the body constant. This embodiment of the device can be used similarly to an ab-roller to perform various core workouts. In said workouts, a user grabs the body with at least one hand and rolls the device away from their body while kneeling.

In one embodiment, the body can be used as a hand grip for performing elevated pushups. In this embodiment, the body is received by at least one base. The base adequately supports and prevents rotation of the end caps and allows the body to remain stationary and used as a pushup grip while stable.

In one embodiment, the device may also be comprised of at least one resistance band. The band is comprised of a first end and a second end. Each end is comprised of at least one fastener that allows each end to attach around/to the body. In this manner, the band can be connected to the body and the band can also be attached around the bottom of a user's foot while performing a core exercise to provide additional resistance.

The present invention is also comprised of a method of using the device. First, a device is provided comprised of a body comprised of at least one recessed area, at least one appendage, and at least two caps that rotate 360 degrees relative to the Y-axis of the body. Then, the device can be placed on a ground surface and a user can kneel or plank on said ground surface. Optionally, a user can extend a resistance band from a housing, adjust the length (and thus resistance) of the band via at least one fastener of the band, attach both ends of the band to the body via at least one fastener of each end, and place the band around a bottom of a user's foot. Then, a user can extend their arms to roll the body away from their body while using their core to keep their body above the ground surface. Then, a user can retract their arms to roll the body towards their body while using their core to keep their body above the ground surface.

The present invention is also comprised of a second method of using the device. First, a device is provided comprised of a body comprised of at least one recessed area, at least one appendage, and at least two caps that rotate 360 degrees relative to the Y-axis of the body, and a base that receives and inhibits movement of the body. Then, the base can be placed on a ground surface and a user can place the caps of the body into a channel of each side wall of the base such that the caps also rest in a recessed area of a bottom wall of the base. Optionally, a user can extend a resistance band from a housing, adjust the length (and thus resistance) of the band via at least one fastener of the band, attach both ends of the band to the body via at least one fastener of each end, and place the band around their shoulder/back area. Then, a user can get into a pushup position while gripping the body with their hand. Finally, a user can perform a pushup while gripping the body.

Accordingly, the exercise device of the present invention is particularly advantageous as it provides an improved exercise device for performing ab/core exercises. The device also provides an improved exercise device for performing pushups. More specifically, the device provides an ergonomic grip and hand placement for a user while performing push-ups and/or ab/core exercises. In this manner, the exercise device overcomes the limitations of existing exercise devices for performing pushups and ab/core exercises known in the art.

Referring initially to the drawings, FIG. 1 illustrates a front perspective view of one potential embodiment of an exercise device 100 of the present invention in accordance with the disclosed architecture. The device 100 is comprised of a body 110 comprised of at least one recessed area 112, at least one appendage 114, and at least two ends 120, 130. The device 100 can be used to perform various core and upper body exercises.

Figure 2:
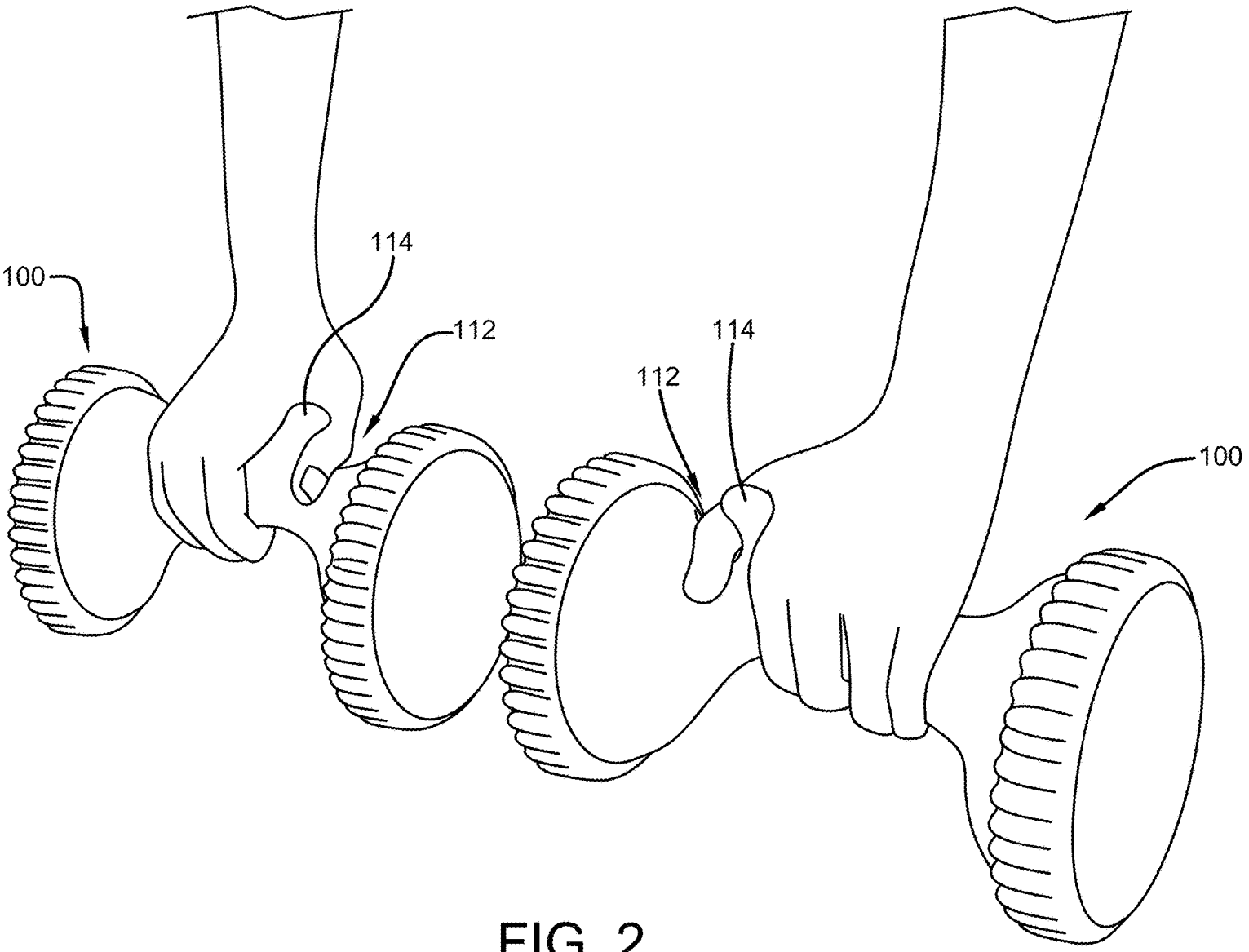
FIG. 2 illustrates a front perspective view of one potential embodiment of an exercise device of the present invention while being gripped by a user in accordance with the disclosed architecture.

The body 110 of the device 100 is comprised of at least one recessed area 112. The recessed area 112 receives the thumb of a user, wherein the thumb is placed around an appendage 114 that extends away from the body 110, as seen in FIG. 2. The shape and spatial relationship between the body 110, the recessed area 112, and appendage 114 allow a user to grip the body 110 ergonomically while reducing wrist strain. In different embodiments, the recessed area 112 and appendage 114 may be positioned on the body 110 to accommodate a right-handed or left-handed grip on the body 110. The body 110 may be made from any material that promotes grip. The body 110 may also be comprised of a raised or recessed texture to promote grip.

Figure 3:
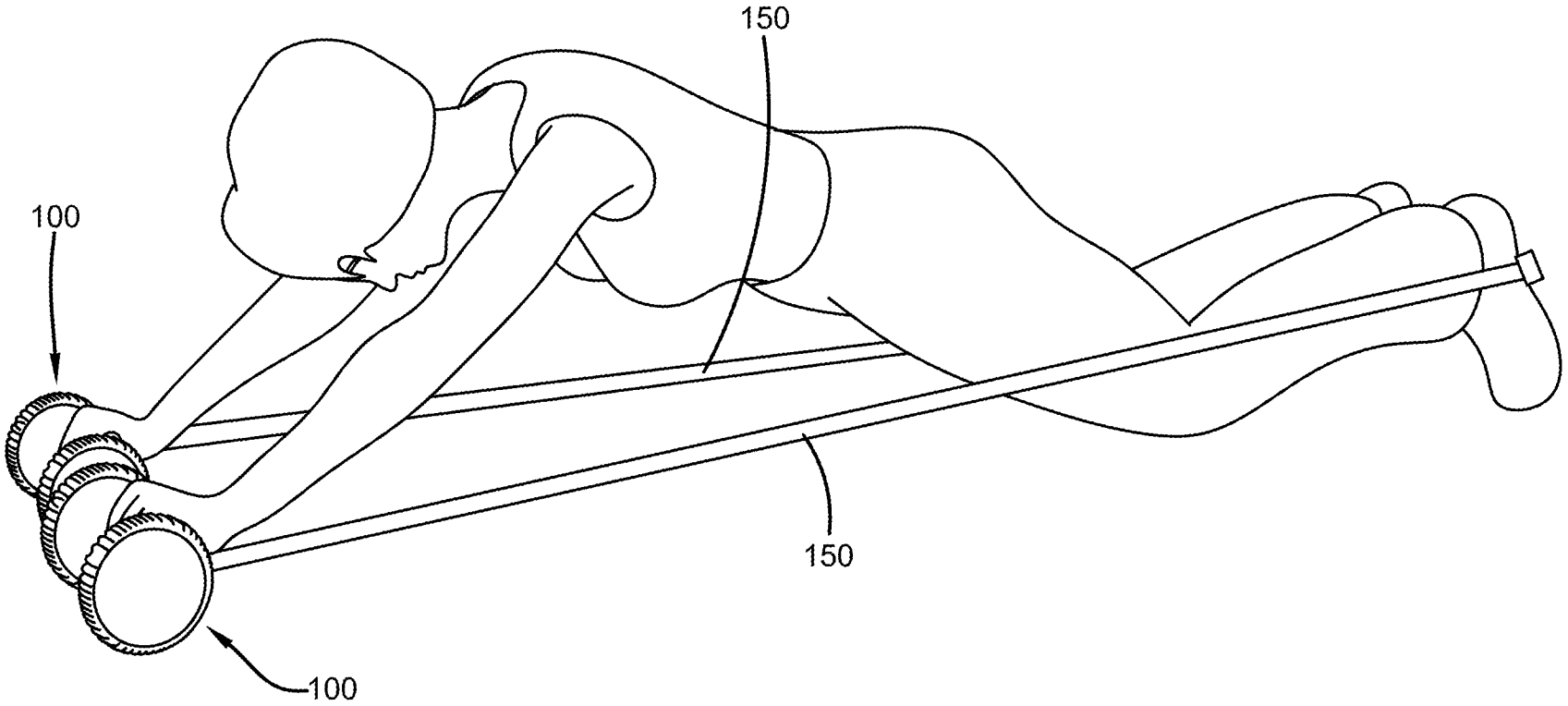
FIG. 3 illustrates a front perspective view of one potential embodiment of an exercise device of the present invention while being gripped by a user performing a core/ab exercise with a resistance band in accordance with the disclosed architecture.

The body 110 is also comprised of two ends 120, 130. The ends 120, 130 are each comprised of at least one cap 122, 132 that are preferably circular to allow the body 110 to roll while performing core exercises, as seen in FIG. 3. In one embodiment the caps 122, 132 are smooth. In another embodiment, the caps 122, 132 are ridged to prevent the caps 122, 132 from excessively slipping on a ground surface while being used to exercise. The caps 122, 132 preferably rotate 360 degrees relative to the Y-axis of the body 110 to allow the body 110 to move while keeping the user's grip angle on the body 110 constant.

This embodiment of the device 100 can be used similarly to an ab-roller to perform various core workouts. In said workouts, a user grabs the body 110 with at least one hand and rolls the device 100 away from their body while kneeling, as seen in FIG. 3.

Figure 4:
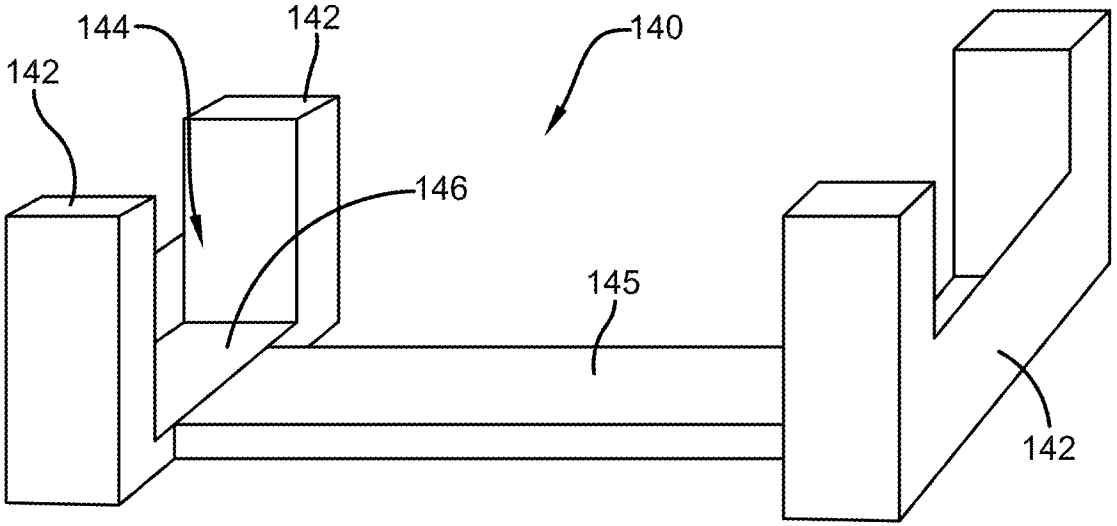
FIG. 4 illustrates a front perspective view of a base of one potential embodiment of an exercise device of the present invention in accordance with the disclosed architecture.
Figure 5:
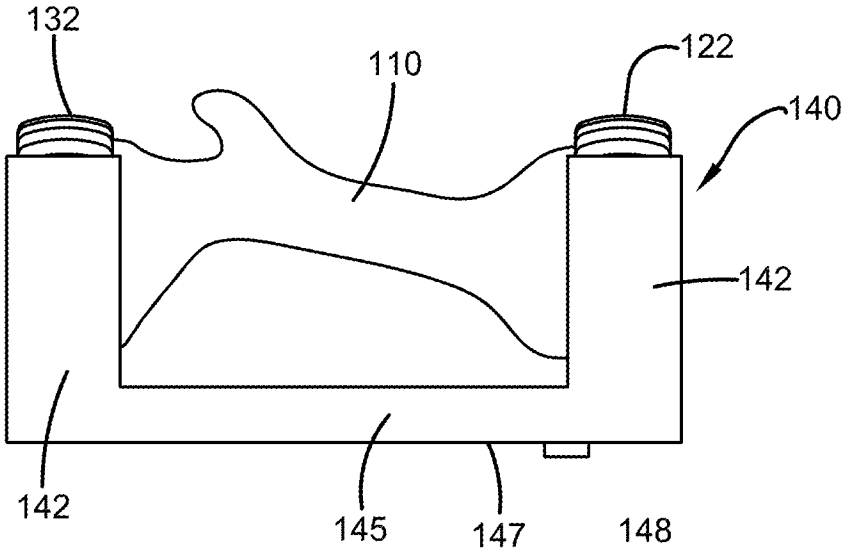
FIG. 5 illustrates a front view of a base of one potential embodiment of an exercise device of the present invention wherein the body is within the base in accordance with the disclosed architecture.

In one embodiment, the body 110 can be used as a hand grip for performing elevated pushups. In this embodiment, the body 110 is received by at least one base 140, as seen in FIG. 5. The base 140 is comprised of a pair of spaced apart, parallel side walls 142, as seen in FIG. 4. Each side wall 142 may be comprised of at least one channel 144 that receives each end cap 122, 132. A bottom wall 145 of the base 140 may also be comprised of at least one recessed area 146 that receives part of each or either end cap 122, 132. In this manner, the channel 144 and recessed area 146 adequately supports and prevents rotation of the end caps 122, 132 and allows the body to remain stationary and used as pushup grip while stable. The bottom surface 147 of the bottom wall 145 may also be comprised of a non-slip bottom surface 147 comprised of a grip material 148 such as, but not limited to, non-slip rubber. Said material may also be comprised of a raised or recessed texture for additional grip.

Figure 6:
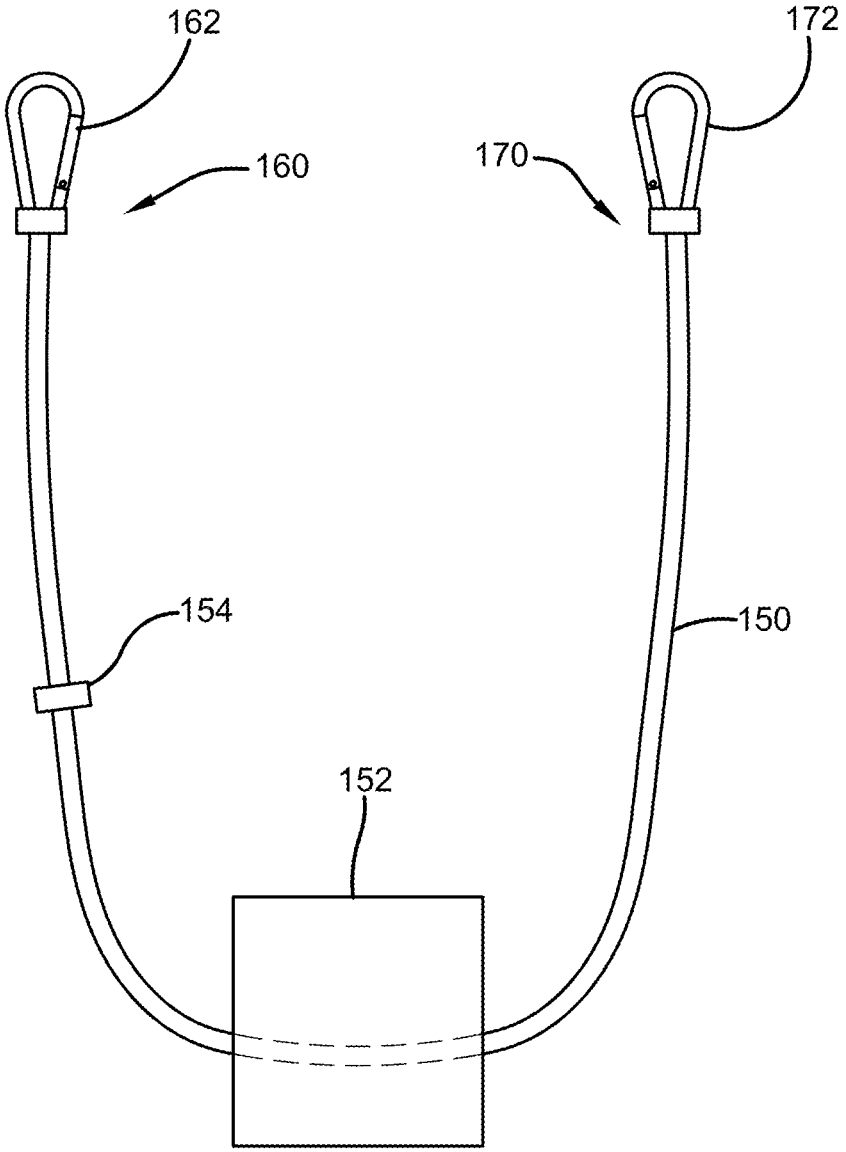
FIG. 6 illustrates a front perspective view of a resistance band of one potential embodiment of an exercise device of the present invention in accordance with the disclosed architecture.

In one embodiment, the device 100 may also be comprised of at least one resistance band 150, as seen in FIG. 6. The band 150 may be made of any material and may provide any level of resistance. The length of the band (and thus the resistance) may be adjusted via at least one adjustment fastener 154 such as, but not limited to, a sliding fastener. In one embodiment, the band 150 is comprised of at least one housing 152, wherein the band 150 is retractable within the housing 152 for storage/transport.

The band 150 is comprised of a first end 160 and a second end 170. Each end 160, 170 is comprised of at least one fastener 162, 172 that allows each end 160, 170 to attach around/to the body 110. The fastener 162, 172 may include, but is not limited to, a clip, a clamp, a tie, a loop, etc. In this manner, the band 150 can be connected to the body 110 and the band 150 can also be attached around the bottom of a user's foot while performing a core exercise to provide additional resistance, as seen in FIG. 3.

Figure 7:
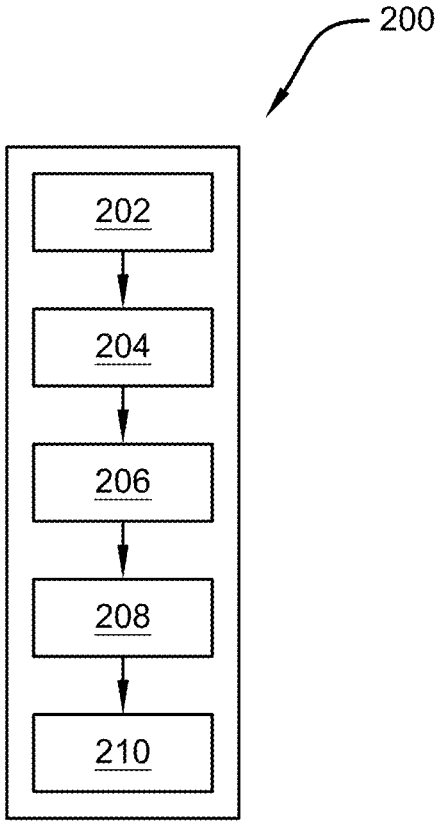
FIG. 7 illustrates a flowchart of a method of using one potential embodiment of an exercise device of the present invention in accordance with the disclosed architecture.

The present invention is also comprised of a method of using 200 the device 100, as seen in FIG. 7. First, a device 100 is provided comprised of a body 110 comprised of at least one recessed area 112, at least one appendage 114, and at least two caps 122, 132 that rotate 360 degrees relative to the Y-axis of the body 110 [Step 202]. Then, the device 100 can be placed on a ground surface and a user can kneel or plank on said ground surface [Step 204]. Optionally, a user can extend a resistance band 150 from a housing 152, adjust the length (and thus resistance) of the band 150 via at least one fastener 154 of the band 150, attach both ends 160, 170 of the band 150 to the body 110 via at least one fastener 162, 172 of each end 160, 170 and place the band 150 around a bottom of a user's foot [Step 206]. Then, a user can extend their arms to roll the body 110 away from their body while using their core to keep their body above the ground surface [Step 208]. Then, a user can retract their arms to roll the body 110 towards their body while using their core to keep their body above the ground surface [Step 210].

Figure 8:
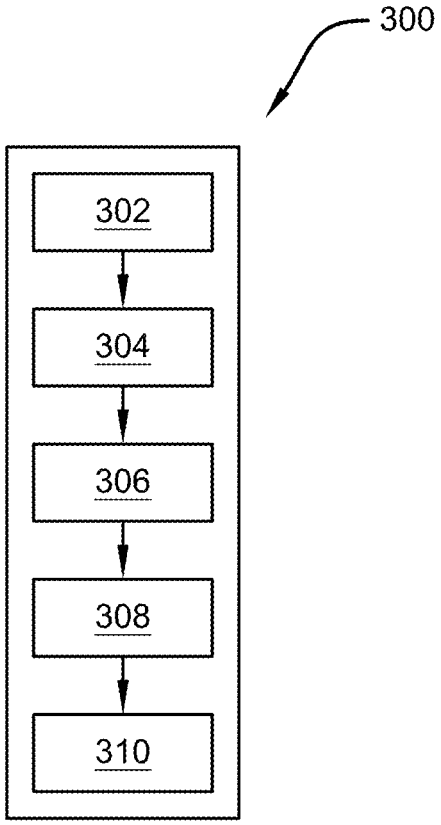
FIG. 8 illustrates a flowchart of a method of using one potential embodiment of an exercise device of the present invention in accordance with the disclosed architecture.

The present invention is also comprised of a second method of using 300 the device 100, as seen in FIG. 8. First, a device 100 is provided comprised of a body 110 comprised of at least one recessed area 112, at least one appendage 114, and at least two caps 122, 132 that rotate 360 degrees relative to the Y-axis of the body 110, and a base 140 that receives and inhibits movement of the body 110 [Step 302]. Then, the base 140 can be placed on a ground surface and a user can place the caps 122, 132 of the body 110 into a channel 144 of each side wall 142 of the base such that the caps 122, 132 also rest in a recessed area 146 of a bottom wall 145 of base 140 [Step 304]. Optionally, a user can extend a resistance band 150 from a housing 152, adjust the length (and thus resistance) of the band 150 via at least one fastener 154 of the band 150, attach both ends 160, 170 of the band 150 to the body 110 via at least one fastener 162, 172 of each end 160, 170 and place the band 150 around their shoulder/back area [Step 306]. Then, a user can get into a pushup position while gripping the body 110 with their hand [Step 308]. Finally, a user can perform a pushup while gripping the body [Step 310].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "exercise device" and "device" are interchangeable and refer to the exercise device 100 of the present invention.

Notwithstanding the foregoing, the exercise device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the exercise device 100 as shown in the FIGS. are for illustrative purposes only, and that many other sizes and shapes of the exercise device 100 are well within the scope of the present disclosure. Although the dimensions of the exercise device 100 are important design parameters for user convenience, the exercise device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An exercise device comprising:

a body comprised of a first end cap positioned at a first end of the body and a second end cap positioned around a second end of the body;

an appendage positioned on the body; and a recessed area positioned on the body, wherein the first and second end caps are ridged end caps.

2. The exercise device of claim 1, wherein the first end cap and the second end cap can rotate 360 degrees relative to a Y-axis of the body.

3. The exercise device of claim 1, wherein the body is comprised of a texture.

4. The exercise device of claim 1, wherein the first end cap and the second end cap are comprised of a circular shape.

5. The exercise device of claim 1 further comprised of a resistance band.

6. The exercise device of claim 5, wherein the resistance band is comprised of a housing that the resistance band retracts into.

7. The exercise device of claim 5, wherein the resistance band is comprised of a first fastener and a second fastener.

8. The exercise device of claim 6, wherein the resistance band is adjustable in length.

9. An exercise device comprising:

a body comprised of a first end cap positioned at a first end of the body and a second end cap positioned around a second end of the body;

an appendage positioned on the body;

a recessed area positioned on the body; and a base comprised of a first sidewall comprised of a first channel that receives the first end cap, a second sidewall comprised of a second channel that receives the second end cap, and a bottom wall comprised of a recessed area configured to receive a portion of the first and second end caps;

wherein the bottom wall of the base further comprises a non-slip bottom surface comprising a grip material; and further wherein the first and second end caps are ridged end caps.

10. The exercise device of claim 9, wherein the first end cap and the second end cap can rotate 360 degrees relative to a Y-axis of the body.

11. The exercise device of claim 9, wherein the body is comprised of a texture.

12. The exercise device of claim 9, wherein the first end cap and the second end cap are comprised of a circular shape.

13. The exercise device of claim 9 further comprised of a resistance band.

14. The exercise device of claim 13, wherein the resistance band is comprised of a housing that the resistance band retracts into.

15. The exercise device of claim 13, wherein the resistance band is comprised of a first fastener and a second fastener.

16. The exercise device of claim 13, wherein the resistance band is adjustable in length.

17. A method of using an exercise device, the method comprising the following steps:

providing an exercise device comprised of a body comprised of a recessed area, an appendage, and a first cap and a second cap wherein both the first cap and the second cap rotate 360 degrees relative to a Y-axis of the body;

providing a base comprising a first sidewall, a second sidewall, and a non-slip bottom surface comprising a grip material;

placing the body within the base on a ground surface;

kneeling or planking on the ground;

extending a user's arm to roll the body away from a body of the user while keeping the body of the user above the ground surface; and retracting a user's arm to roll the body towards the body of the user while keeping the body of the user above the ground surface.

18. The method of using an exercise device of claim 17, wherein the exercise device is further comprised of a resistance band that can attach to the body.

* * * * *